US006965087B2

(12) United States Patent
Wolber et al.

(10) Patent No.: US 6,965,087 B2
(45) Date of Patent: Nov. 15, 2005

(54) ELECTRIC SWITCH

(75) Inventors: Ralph Wolber, Spaichingen (DE); Rainer Kizele, Tuttlingen (DE); Heinrich Müller, Tuttlingen (DE); Thomas Mejerl, Rottweil (DE)

(73) Assignee: Marquardt GmbH, Rietheim-Weilheim (DE)

( * ) Notice: Subject to any disclaimer, the term of this patent is extended or adjusted under 35 U.S.C. 154(b) by 22 days.

(21) Appl. No.: 10/836,325

(22) Filed: Apr. 30, 2004

(65) Prior Publication Data

US 2004/0262140 A1 Dec. 30, 2004

Related U.S. Application Data

(63) Continuation of application No. PCT/DE02/04039, filed on Oct. 30, 2002.

(30) Foreign Application Priority Data

Nov. 2, 2001 (DE) ..... 101 53 871
May 22, 2002 (DE) ..... 102 22 498

(51) Int. Cl.[7] ..... H01H 5/08; H01H 3/12

(52) U.S. Cl. ..... 200/437; 200/524; 200/529; 200/533

(58) Field of Search ..... 200/405, 410, 200/411, 412, 416, 417, 424, 431, 434, 437–439, 449, 450, 453, 520, 523, 524, 529, 533, 534

(56) References Cited

U.S. PATENT DOCUMENTS 2,051,654 A 8/1936 Sanford et al.
2,524,410 A 10/1950 Trainor
3,999,024 A 12/1976 Marquardt
4,383,149 A 5/1983 Fulton
4,504,712 A * 3/1985 Donnelly et al. ..... 200/529
4,543,459 A * 9/1985 Hayashida ..... 200/453
4,654,487 A * 3/1987 Sawada ..... 200/1 V
4,758,694 A 7/1988 Burdick
5,651,452 A * 7/1997 Schaeffeler et al. ..... 200/437
6,028,279 A * 2/2000 Suryan et al. ..... 200/524
6,166,345 A * 12/2000 Ito et al. ..... 200/437

FOREIGN PATENT DOCUMENTS

DE 38 09 144 A1 9/1989
DE 42 02 214 A1 7/1993
DE 43 30 576 C1 11/1994
EP 0 232 765 A2 8/1987
GB 2 110 472 A1 6/1983

* cited by examiner

*Primary Examiner*—Michael A. Friedhofer
(74) *Attorney, Agent, or Firm*—Burr & Brown

(57) ABSTRACT

An electric switch, in particular for a high load, such as a power switch. The switch has a contact system comprising a movable switching contact and at least one stationary contact. A movable actuation member, when moved, interacts with the switching contact for the purpose of switching the contact system. If appropriate, the switch may also have a movable locking means, which interacts with the actuation member in an interlocking manner. The actuation member is in operative connection with a lever in such a way that, when there is movement of the actuation member, the lever carries out a pivoting movement. The pivoting movement of the lever moves the switching contact for the purpose of switching and/or the locking means for the purpose of interlocking, in particular with increasing transformation of the displacement covered by the actuation member.

17 Claims, 10 Drawing Sheets

ELECTRIC SWITCH

CROSS REFERENCE TO RELATED APPLICATIONS

This application is a continuation of International Application No. PCT/DE02/04039 having an international filing date of Oct. 30, 2002, which designated the United States, the entirety of which is incorporated herein by reference.

This application also claims the benefit of German Application No. 101 53 871.5, filed Nov. 2, 2001, and German Application No. 102 22 498.6, filed May 22, 2002, the entireties of which are incorporated herein by reference.

FIELD OF THE INVENTION

The invention relates to an electric switch according to the precharacterizing clause of patent claim In electrical and domestic appliances, for example washing machines, dishwashers or the like, electric switches serve as power switches. For this purpose, the switch must be suitable for switching a high load.

BACKGROUND OF THE INVENTION

Such an electric switch is known for example from DE 42 02 214 A1. This switch has a contact system comprising a movable switching contact and at least one stationary contact. Furthermore, the switch has an actuation member, which can be moved between a starting position and an actuating position and, when moved, interacts with the switching contact for the purpose of switching the contact system. Finally, a movable locking means may interact with the actuation member in an interlocking manner in the actuating position.

Apart from the power switch, further switches, which are frequently designed in the form of short-stroke buttons, for example with a stroke of about 2 to 3 mm, are arranged in electrical appliances and/or domestic appliances for the operator to control other functions. However, the switch known from DE 42 02 214 A1 has a long actuating displacement, to be precise of approximately 5 mm, so that when it is arranged as a power switch in the control panel it has different actuating characteristics than the other switches. On the other hand, a reduction in the actuating displacement of the switch does not appear to be possible on account of the technical specifications to be considered, such as for example the various tolerance positions of the individual parts of the switch, the contact erosion in the contact system occurring over the lifetime of the switch, the contact opening clearance required for the switching of high power of at least 3 mm, the application of the necessary contact force, the reliable function of the switch, or the like.

SUMMARY OF THE INVENTION

The invention is based on the object of providing an electric switch which is suitable for switching high power levels and has a small actuating displacement. In particular, it is intended that the electric switch can be used as a power switch in control panels equipped with short-stroke buttons, in order for it to fit in with the operator control philosophy of modern domestic appliances. At the same time, the actuating force for the electric switch should not increase significantly.

This object is achieved in the case of an electric switch of the generic type by the characterizing features of claim 1.

In the case of the electric switch according to the invention, the actuation member is in operative connection with a lever in such a way that the lever carries out a pivoting movement when there is movement of the actuation member. For its part, the pivoting movement of the lever then moves the switching contact for the purpose of switching and/or the locking means for the purpose of interlocking. The switch can consequently be advantageously implemented in a locking and/or momentary-contacting type of design. In both cases, however, an increasing transformation of the displacement covered by the actuation member is achieved by the pivoting movement of the lever, so that even a small actuating displacement of the actuation member moves the switching contact and/or the locking means with a sufficiently large displacement. As a result, a contact opening clearance of more than 3 mm is made possible even with a short actuating displacement, so that the switch according to the invention is suitable both for switching high loads and for control currents. In particular, in the case of the switch according to the invention, the contact force is not in a direct relationship, or only in a weak relationship, with the actuating force, so that the contact force can only have at most a slight influence on the actuating force. Further configurations of the invention are the subject of the subclaims.

The switch, having a housing, may have a number of contact systems, each with a switching contact. For example, when it is used as a power switch, a two-pole configuration with at least two contact systems is appropriate. In a particularly preferred configuration, a common lever serves for the movement not only of the switching contact and/or of the switching contacts but also, if appropriate, of the locking means. As a result, the required actuating displacement for functionally reliable interlocking and for failsafe switching is achieved both at the locking means and at the contact system. Advantageously, no additional installation space is required for this in the housing of the switch; rather, the switch for high loads can be provided with a small housing.

The lever may be pivotably mounted on a bearing in the housing of the switch. In a further configuration, the lever is formed as a one-armed lever. The bearing is then located at one end of the lever. Such a configuration also contributes to reducing the installation space required for the switch.

In one type of design of the switch, the switching contact is configured in the form of a rocker. One end of the lever, this being the end opposite from the bearing of the lever in the case of a one-armed lever, bears with an elastic force against the switching contact. When there is movement of the lever, the switching contact in the form of a rocker is then switched. This configuration ensures that the actuating force for moving the actuation member only has at most a slight influence on the contact force exerted by the switching contact. Furthermore, the lever may have a sleeve, in which a compression spring is arranged for exerting the elastic force. This compression spring acts on a control cam, which in turn acts on the switching contact, which likewise contributes to the compactness of the switch.

The locking means may comprise an approximately heart-shaped locking camway and a pin engaging in the locking camway. The locking camway can preferably be moved by means of the lever. The locking camway is then expediently arranged on one side of the lever, to be precise in the case of a one-armed lever on the side approximately opposite from the bearing, which contributes to particularly efficient use of the space present on the lever. The pin may also be configured approximately in the manner of a bow. One end of the bow is held in the housing of the switch and the other end of the bow engages as a pin in the locking camway.

When there is movement of the locking camway, the pin is then acted on by an elastic force directed counter to the deflection by the locking camway and in a failsafe manner arrives in the locking position in the heart-shaped locking camway or else leaves the locking position again. Such a locking switch operates in a very failsafe manner.

The electric switch is preferably configured as a short-stroke pushbutton switch. For this purpose, the actuation member is formed as a substantially linearly movable pushbutton. The pushbutton can be moved against the force of a spring and part of it protrudes out of the housing for manual access by the user. For particularly efficient and space-saving articulation of the lever on the pushbutton, the lever passes through a receptacle on the actuation member, which is arranged on the part of the actuation member located inside the housing of the switch, approximately transversely with respect to the direction of movement of the actuation member. Consequently, when there is movement of the actuation member, the lever pivots in a simple way.

In another type of design of the switch, the contact system is formed as a snap-action contact system. For this purpose, the switching contact is configured as a snap-action switching contact, so that, when there is movement of the lever, the switching contact switches between its two end positions with snapping action. The switching contact is pivotably mounted in a knife-edge bearing, which may be arranged for example at an electrical terminal. A tension spring is fastened by one end to the switching contact and by the other end to the lever. The fastening to the lever may be located on the side opposite from the bearing of the lever. Such a snap-action contact system advantageously offers lower actuating forces and lower noise development than some other contact system.

In a further configuration, the actuation member is formed as a pushbutton which can be moved manually by the user, substantially linearly against a spring force. The actuation member can be moved manually by the user between a starting position and an actuating position, in order to switch the contact system. After the switching of the contact system, the actuation member can return to the starting position of its own accord. Alternatively, the actuation member may be secured in the respective position until the next actuation, in that, as already mentioned, the actuation member is interlocked in the actuating position by the locking means.

If desired, the switching positions of the snap-action contact system may similarly be configured as locking positions. In order to ensure small actuating forces and the desired compactness in this case too, a rocker is pivotably mounted on the actuation member. To establish the operative connection, the rocker engages the lever by means of an arm, to be precise expediently at a kind of slideway on said lever. A spring element, which is restrained by one end on the lever, to be precise on the side opposite from the bearing of the lever, and is in particular a leaf spring or a wire spring, interacts by the other, projecting end with the rocker, in that the projecting end engages in a slot on the rocker. As a result, when there is movement of the actuation member, the lever pivots alternately between two stable end positions, to be precise from one end position into the other end position, respectively. These end positions correspond in turn to the switching positions of the contact system.

In a way corresponding to the space available for the switch in the electrical and/or domestic appliance, the size of the switch can be optimized in the longitudinal direction or transverse direction with respect to the direction of movement of the actuation member. For this purpose, the lever and/or the switching contact may be arranged approximately parallel or approximately perpendicular to the direction of movement of the actuation member. In particular in the case of multi-pole switches with a number of contact systems, it is appropriate moreover to configure the lever approximately in the form of a fork, with two mutually opposite bearings.

The advantages achieved by the invention are, in particular, that the switch can be operated with a short actuating displacement. The short-stroke switch according to the invention allows a uniform operator control philosophy, for example in domestic appliances, where a short-stroke circuit breaker can be used in the control panel for disconnecting the power in addition to the already customary short-stroke buttons for the logic control.

In spite of a small actuating displacement, the switch achieves a large contact opening clearance. The switch according to the invention can be used universally, since both high loads and control currents can be switched. There is a defined time sequence between the contact movements, that is to say opening or closing of the contact system. As a result, a defined time delay is possible, if desired, between the contacts. Furthermore, the contact erosion of the contact system is only at most a minor factor during the lifetime of the switch; in particular, the switching point of the contact system remains approximately constant over the lifetime.

BRIEF DESCRIPTION OF THE DRAWINGS

Exemplary embodiments of the invention are described in more detail below and represented in the drawing, in which.

DETAILED DESCRIPTION OF THE INVENTION

Figure 1:
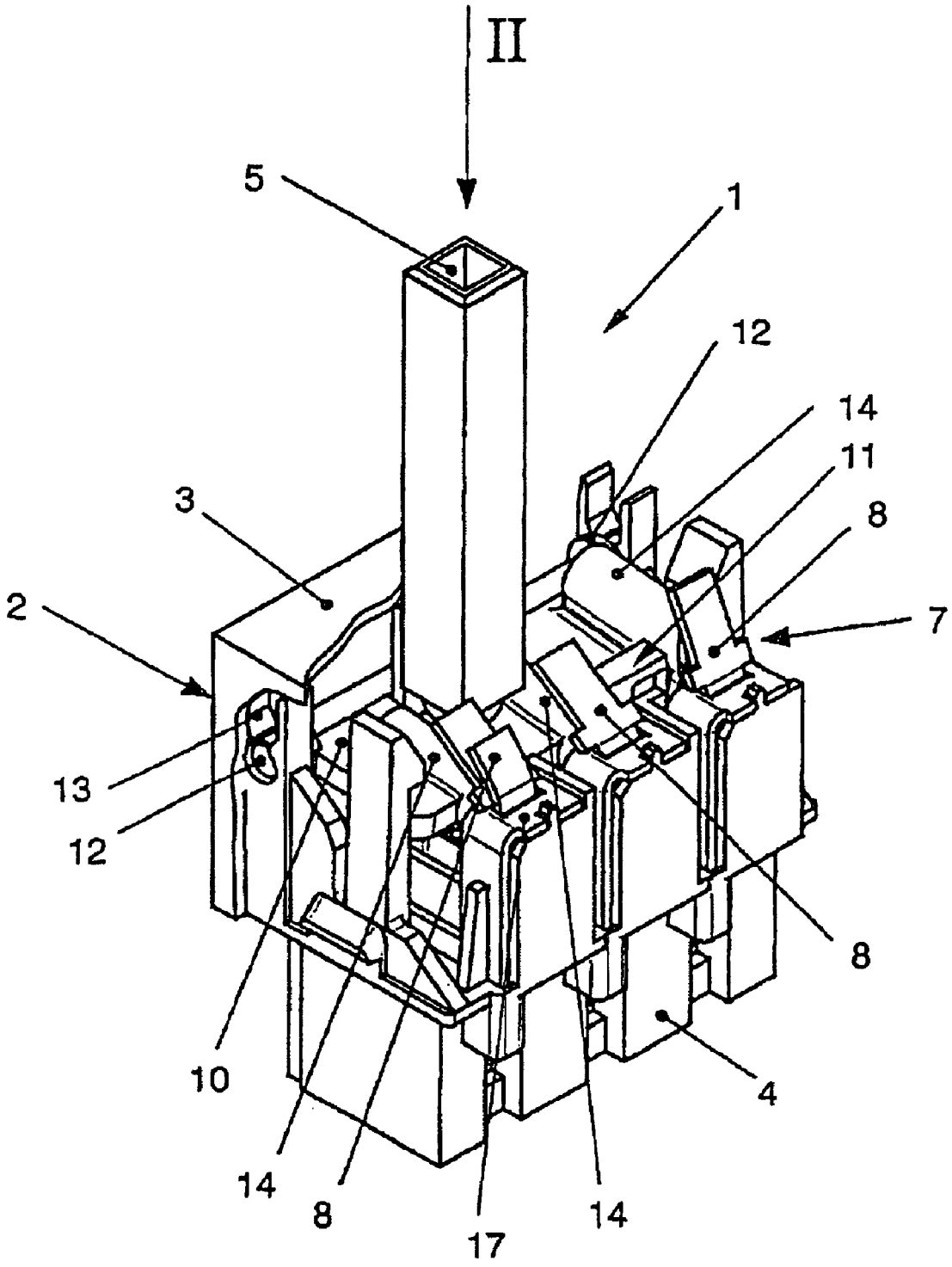
FIG. 1 shows an electric switch with a broken-open housing in a perspective view.

Shown in FIG. 1 is an electric switch 1 according to a first exemplary embodiment, which is suitable for switching a high load. The switch 1 may be used for example as a power switch for an electrical appliance. The switch 1 has a housing 2, which in FIG. 1 is merely represented in a schematic and broken-open form and comprises a cover 3 and a base 4. Protruding out of the housing 2 on the upper side of the cover 3 is an actuation-member 5. The part of the actuation member 5 protruding from housing 2 is accessible to the user for manual operation of the switch 1. The actuation member 5 is formed in the present case as a pushbutton which can be moved substantially linearly against the force of a spring 20, as can be seen in FIG. 4. On the underside, the electrical terminals 6 of the switch 1 that can be seen in FIG. 3 are located in the base 4.

The switch 1 has a three-pole contact system 7, as can be seen from FIG. 1. As FIG. 3 also reveals, the contact system 7 comprises a movable switching contact 8 and at least one stationary contact 9, which are respectively in connection with an electrical terminal 6. The actuation member 5 can be moved manually between a starting position and an actuating position, the actuation member 5, when moved, interacting with the switching contact 8 for the purpose of switching the contact system 7. So, in the actuating position, the contact system 7 is in the switching-on state, in that the switching contact 8 bears against the stationary contact 9. In the starting position, on the other hand, the switching contact 8 is away from the stationary contact 9, so that the contact system 7 is in the switching-off state. It goes without saying that the contact system may also be configured in such a way that, when there is movement of the actuation member, the switching contact switches between two stationary contacts, which however is not shown any further.

The switch 1 also has a lever 10, which is located in the housing 2, as can be seen in more detail in FIG. 1. The actuation member 5 is in operative connection with the lever 10, to be precise in such a way that, when there is movement of the actuation member 5, the lever 10 carries out a pivoting movement. In a first configuration of the invention, the pivoting movement of the lever 10 for its part moves the switching contact 8 for the purpose of switching the contact system 7, as can be seen from FIG. 3. In a second configuration of the invention, a locking switch is concerned, and the switch 1 has a movable locking means 11, which interacts with the actuation member 5 in an interlocking manner in the actuating position and can be seen in FIG. 2. For its part, the pivoting movement of the lever 10 in this case moves the locking means 11 for the purpose of interlocking. In the case of both configurations, an increasing transformation of the displacement covered by the actuation member 5 is achieved on account of the transmission of the movement of the actuation member 5 via the lever 10 to the switching contact 8 and/or the locking means 11. As a result, even when there is a small displacement of the actuation member 5 between the starting position and the actuating position, great displacements are made possible for the switching contact 8 and/or for the locking means 11, so that high power levels can be switched by means of the contact system 7. It is particularly preferred for the switch 1 to be formed in a way corresponding to a combination of the two configurations mentioned, in that the lever 10 moves both the switching contact or switching contacts 8 and the locking means 11, as a common lever that can be seen in FIG. 1. Other expedient developments of the switch 1 are explained in more detail below.

Figure 3:
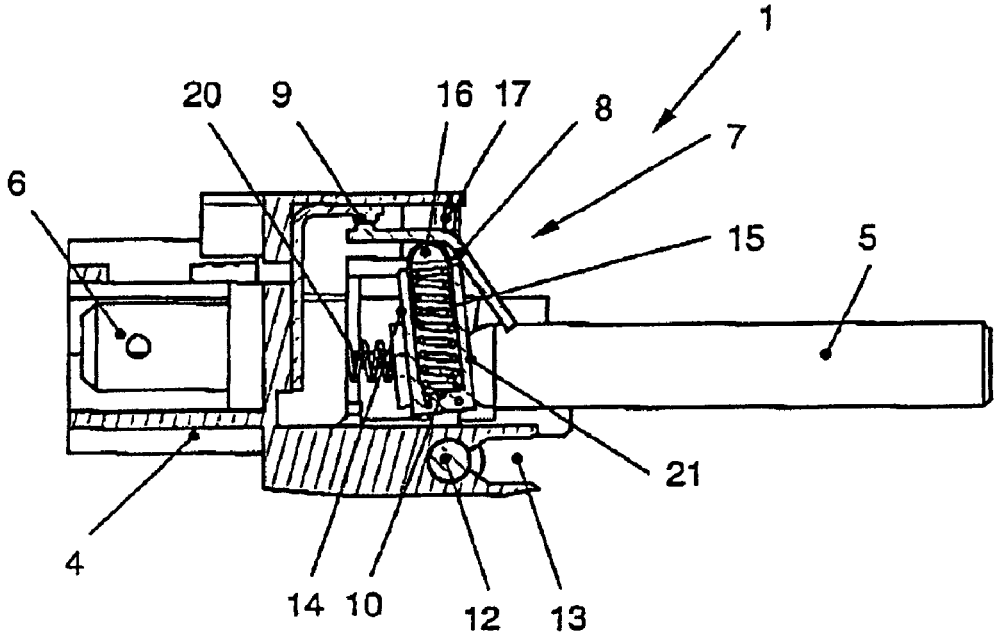
FIG. 3 shows a section along the line 3—3 from FIG. 2.
Figure 4:
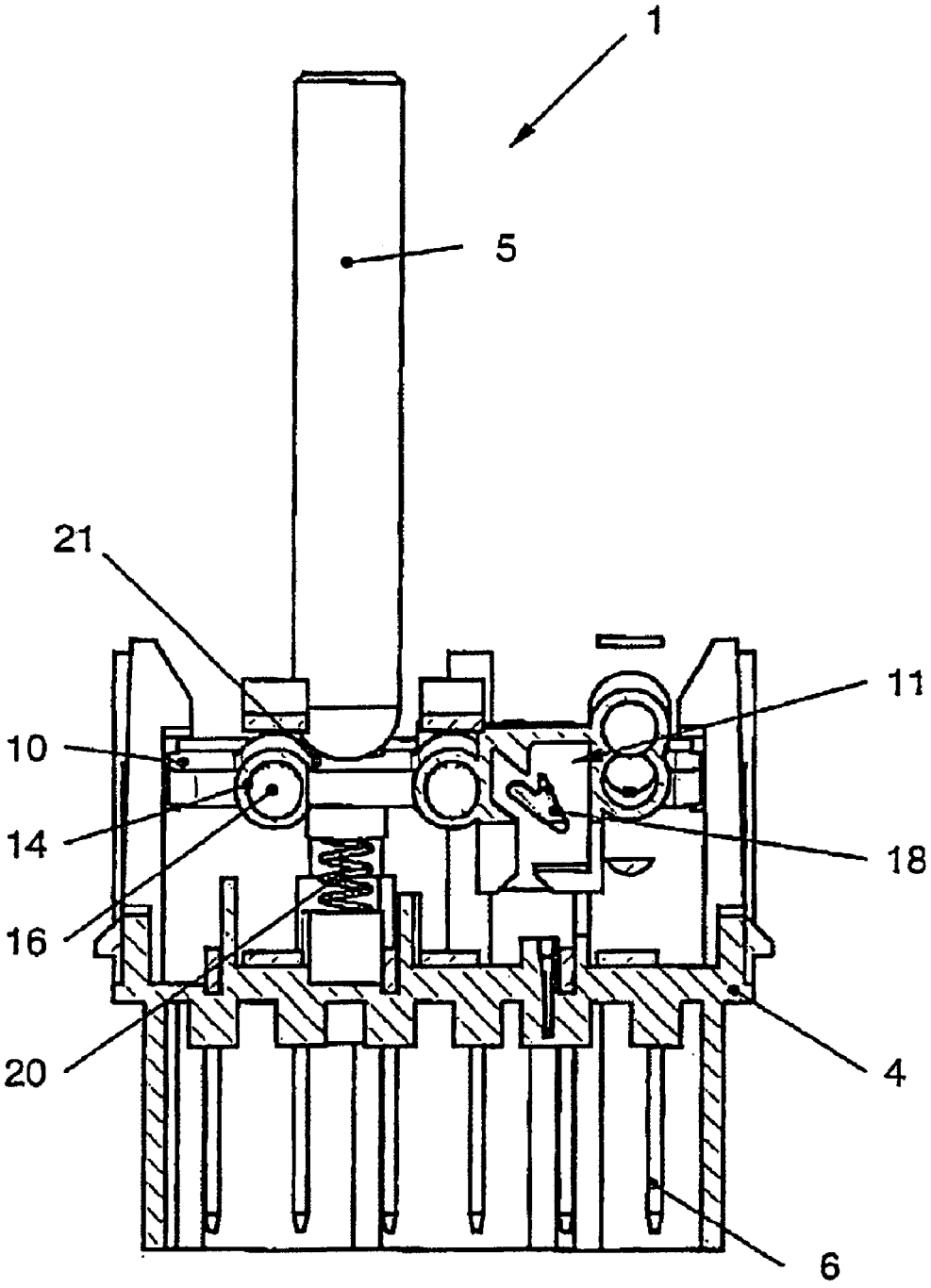
FIG. 4 shows a section along the line 4—4 from FIG. 2.

As FIG. 3 reveals in more detail, the lever 10 is configured as a one-armed lever. At one end of the lever 10 there is a bearing 12 for the pivotable mounting of the lever 10 in the housing 2 of the switch 1. The receptacle 13 for the lever 12 is located in the base 4, it expediently being possible for the bearing 12 to be clipped into the receptacle 13.

The switching contact 8 is configured in the form of a rocker and is mounted approximately centrally in a knife-edge bearing 17. One end of the lever 10, to be precise the end opposite from the bearing 12 of the lever 10, is acted on by an elastic force and bears against the switching contact 8. For this purpose, the lever 10 has a sleeve 14. Arranged in the sleeve 14 is a compression spring 15 for exerting the elastic force. The compression spring 15 acts on a control cam 16 and the control cam 16 finally acts on the switching contact 8. If the control cam 16 is beyond one side of the knife-edge bearing 17, that is to say on the left-hand side of the switching contact 8 in the form of a rocker, as can be seen in FIG. 3, the contact system 7 is in the switching-on state. If the control cam 16 is beyond the other side of the knife-edge bearing 17, that is to say on the right-hand side of the switching contact 8 in the form of a rocker, which is not shown any further however, the contact system 7 is in the switching-off state. Since, as already mentioned, a three-pole contact system 7 is concerned in the present case, the lever 10 is correspondingly equipped with two bearings 12 along its length. In this case, three sleeves 14 together with the control cams 16 for the three switching contacts 8 are arranged lying next to one another on the lever 10, as revealed by FIG. 1 and FIG. 4.

Figure 2:
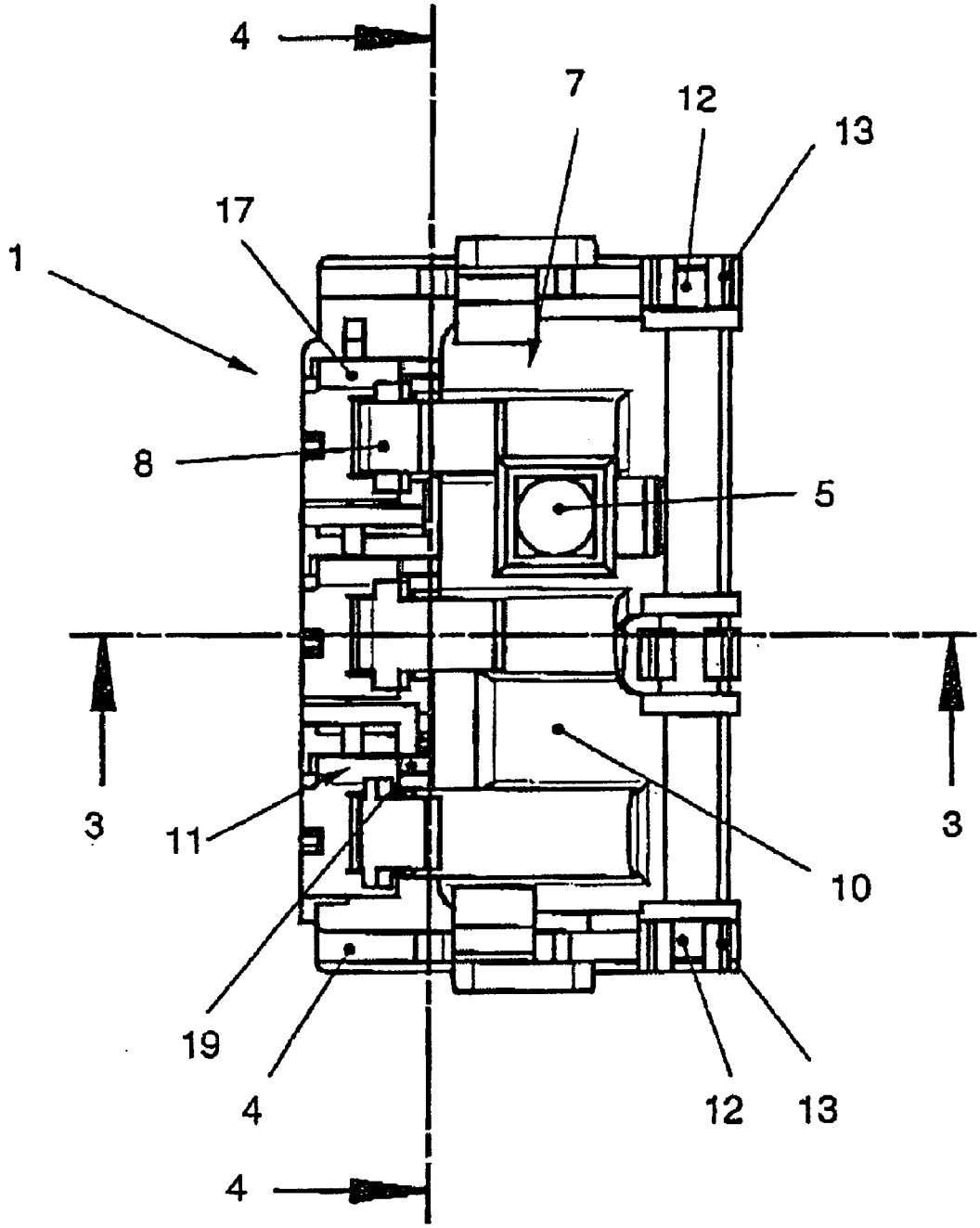
FIG. 2 shows a plan view of the switch according to direction II in FIG. 1.

The locking means 11 comprises an approximately heart-shaped locking camway 18 and a pin 19 engaging in the locking camway 18. The locking camway 18, which can be seen in FIG. 4, is arranged on one side of the lever 10, to be precise on its front side, which is approximately opposite from the bearing 12. The pin 19, which can be seen in FIG. 2, is configured approximately in the manner of a bow, one end of the bow being held in the housing 2, to be precise on the base 4, of the switch 1 and the other end of the bow engaging as an actual pin 19 in the locking camway 18. The locking camway 18 can be moved by means of the lever 10, so that, when there is movement of the locking camway 18, the pin 19 is acted on by an elastic force directed counter to the deflection by the locking camway 18. The corresponding engagement of the pin 19 in the locking camway 18 brought about by the elastic force has the effect that the actuation member 5 is held in a known way in the actuating position in an interlocking manner. It goes without saying that it is also possible in a converse way for the locking camway to be arranged fixedly in the housing of the switch and the pin to be arranged movably by means of the lever, which however is not shown any further.

As can be seen in further detail from FIG. 3, for the pivoting of the lever 10 there is in the actuation member 5 a receptacle 21, which is arranged on the part of the actuation member 5 that is located in the interior of housing 2 of the switch 1. The lever 10 passes through the receptacle 21 approximately transversely to the direction of movement of the actuation member 5. If the actuation member 5 is then moved, the lever 10 in the receptacle 21 is taken along and thereby pivoted.

Figure 5:
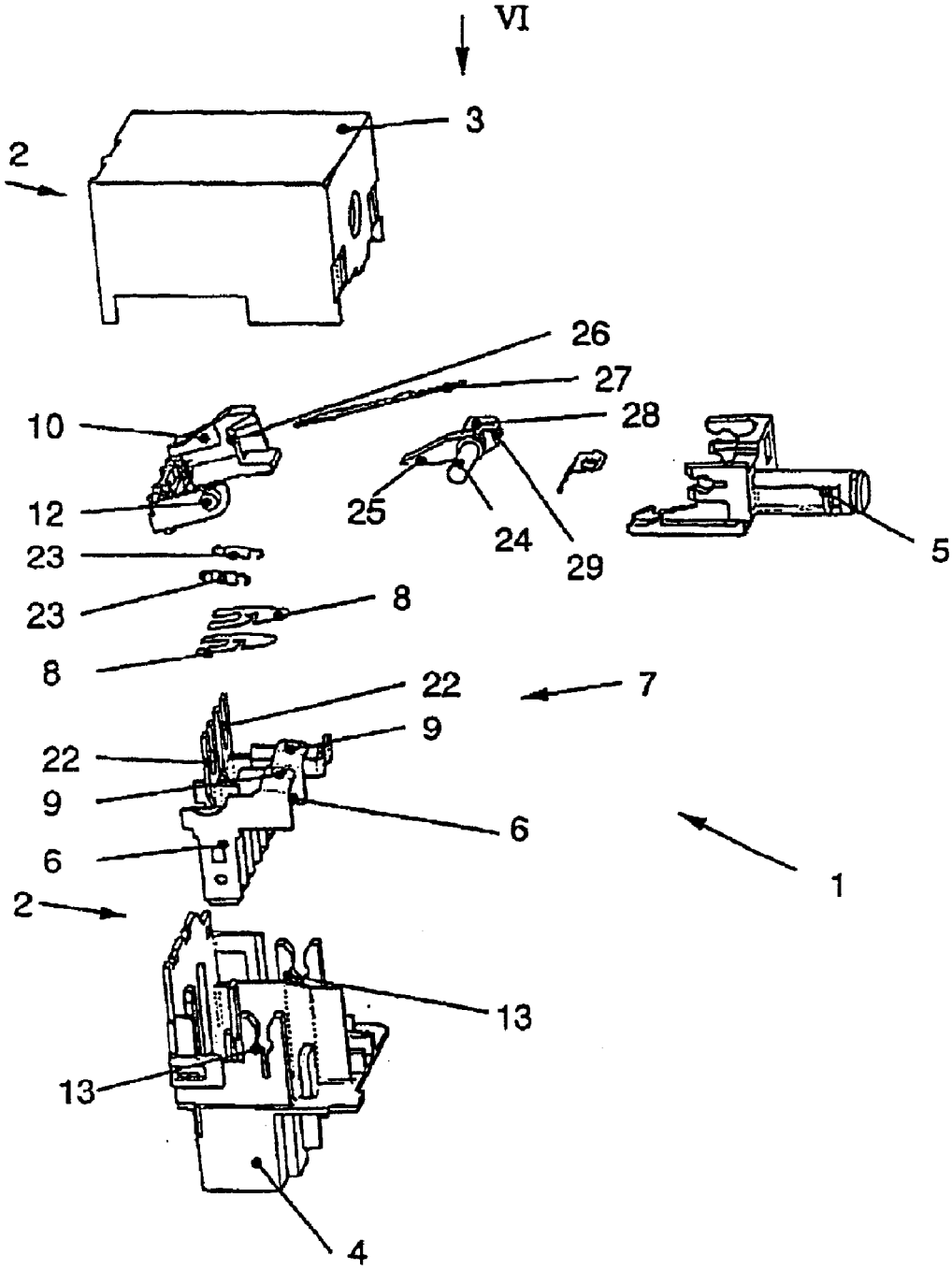
FIG. 5 shows an electric switch according to a further exemplary embodiment in an exploded representation.

An electric switch 1 according to the invention as provided by a second exemplary embodiment is shown in an exploded representation in FIG. 5. The switch 1 has in turn a housing 2, which comprises a cover 3 and a base 4. On one side of the cover 3, an actuation member 5 protrudes out of the housing 2. The actuation member 5 is formed in the present case as a substantially linearly movable pushbutton. On one side of the base 4, electrical terminals 6 of the switch 1 protrude, as can be seen in particular in FIG. 9 or 10.

Figure 6:
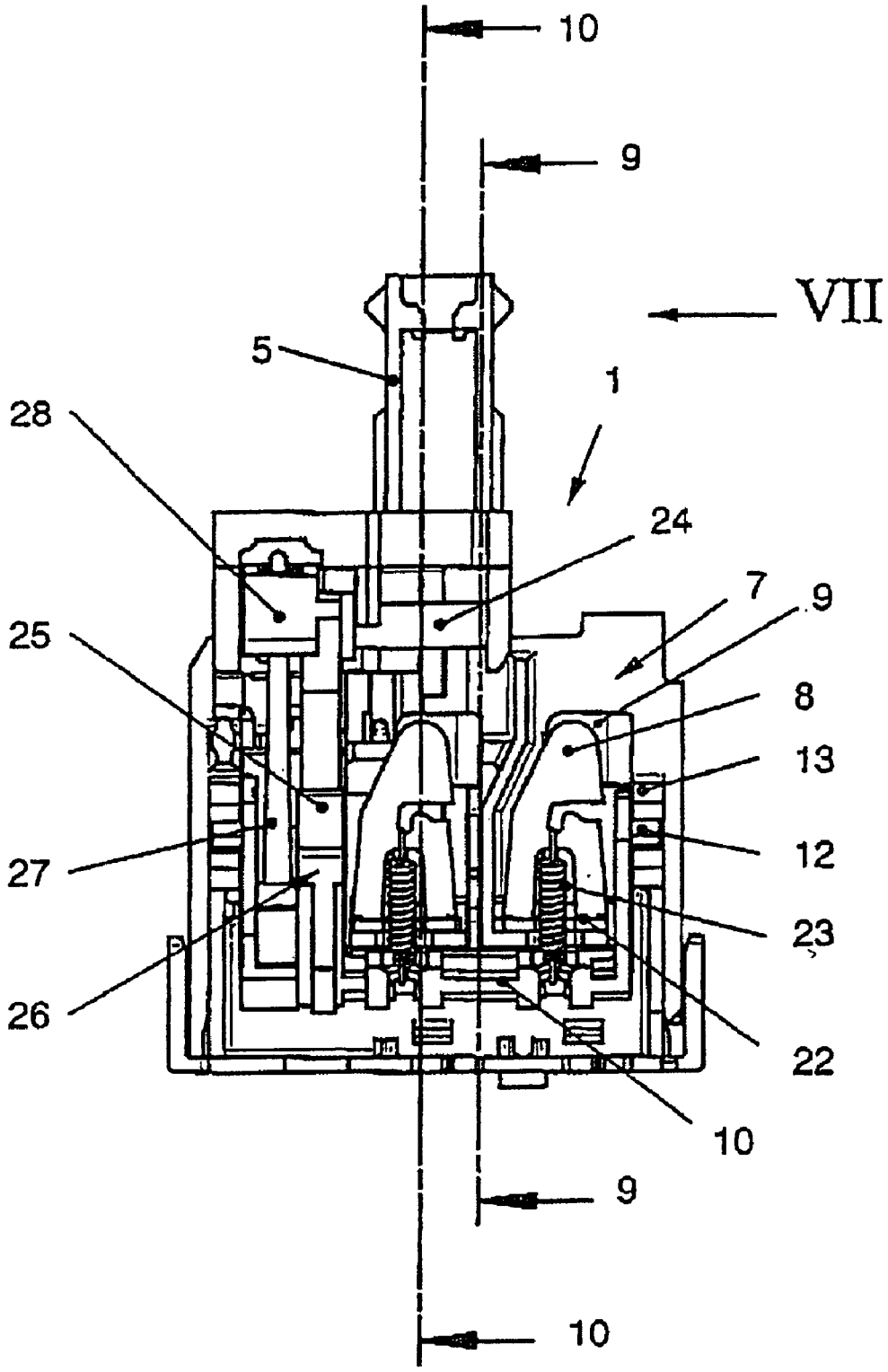
FIG. 6 shows the electric switch, seen from direction VI in FIG. 5, without the cover of the housing.

The switch 1 has a two-pole contact system 7, which is evident from FIG. 6. As FIG. 5 reveals, the contact system 7 comprises a movable switching contact 8 and at least one stationary contact 9, which are respectively in connection with an electrical terminal 6. When there is manual movement of the actuation member 5, the actuation member 5 interacts with the switching contact 8 for the purpose of switching the contact system 7, to be precise between a switching-on state, shown in FIG. 8, of the contact system 7, in which the switching contact 8 bears against the stationary contact 9, and a switching-off state, shown in FIG. 7, of the contact system 7, in which the switching contact 8 is away from the stationary contact 9. It goes without saying that the contact system may also be configured in such a way that, when there is movement of the actuation member, the switching contact switches between two stationary contacts, which however is not shown any further.

The switch 1 also has a lever 10, which is located in the housing 2. The actuation member 5 is in operative connection with the lever 10, to be precise in such a way that, when there is movement of the actuation member 5, the lever 10 carries out a pivoting movement between two end positions, which is evident from FIGS. 7 and 8. In this case, the pivoting movement of the lever 10 for its part moves the switching contact 8 for the purpose of switching the contact system 7. On account of the transmission of the movement of the actuation member 5 via the lever 10 to the switching contact 8, an increasing transformation of the displacement covered by the actuation member 5 is achieved. As a result, even when there is a small displacement of the actuation member 5 when it is manually moved, great displacements are made possible for the switching contact 8, so that high power levels can be switched by means of the contact system 7. Further expedient developments of the switch 1 according to the further exemplary embodiment are explained in more detail below.

Figure 7:
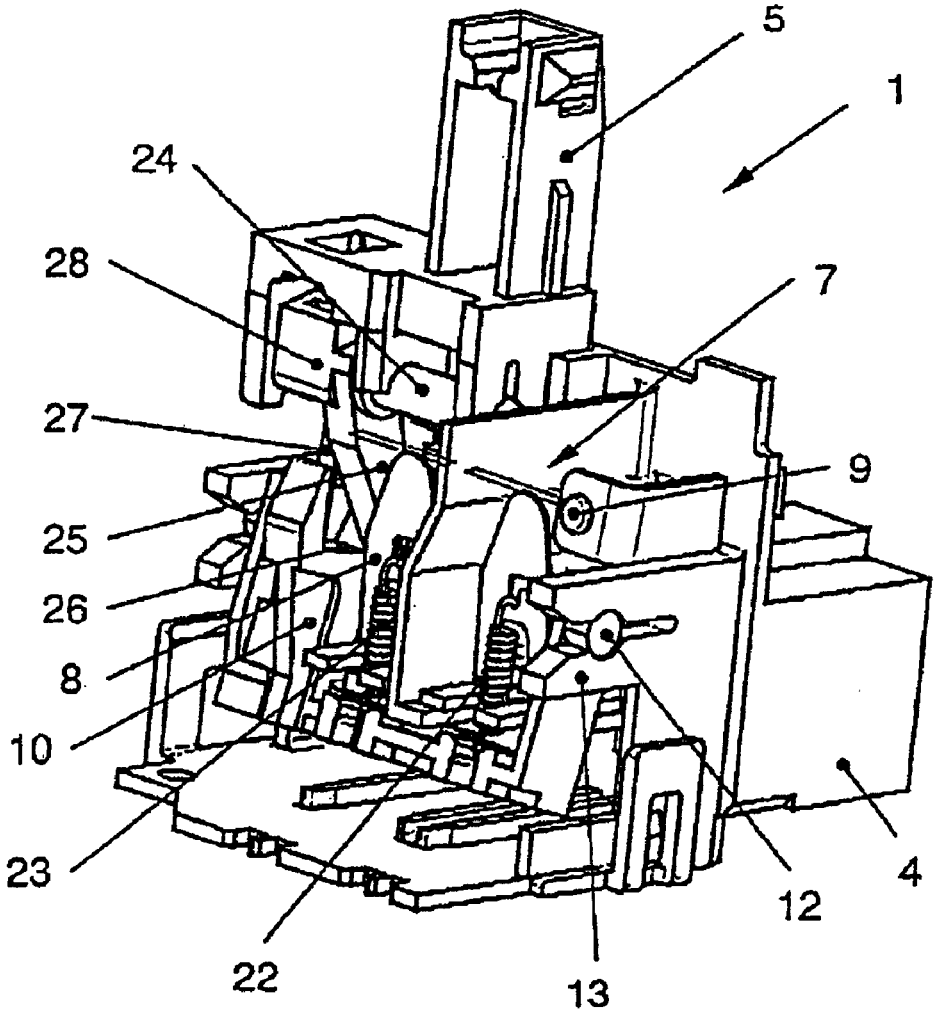
FIG. 7 shows a perspective view of the electric switch, seen approximately from direction VII in FIG. 6, the contact system being in the switching-off state.

As FIG. 7 reveals in more detail, the lever 10 is configured as a one-armed lever. At one end of the lever 10 there is a bearing 12 for the pivotable mounting of the lever 10 in the housing 2 of the switch 1. The receptacle 13 for the lever 12 is located in the base 4, it expediently being possible for the bearing 12 to be clipped into the receptacle 13. In the case of the present multi-pole switch 1, it is appropriate furthermore to configure the lever 10 approximately in the form of a fork, with two mutually opposite bearings 12, as can be seen from FIG. 5.

Figure 9:
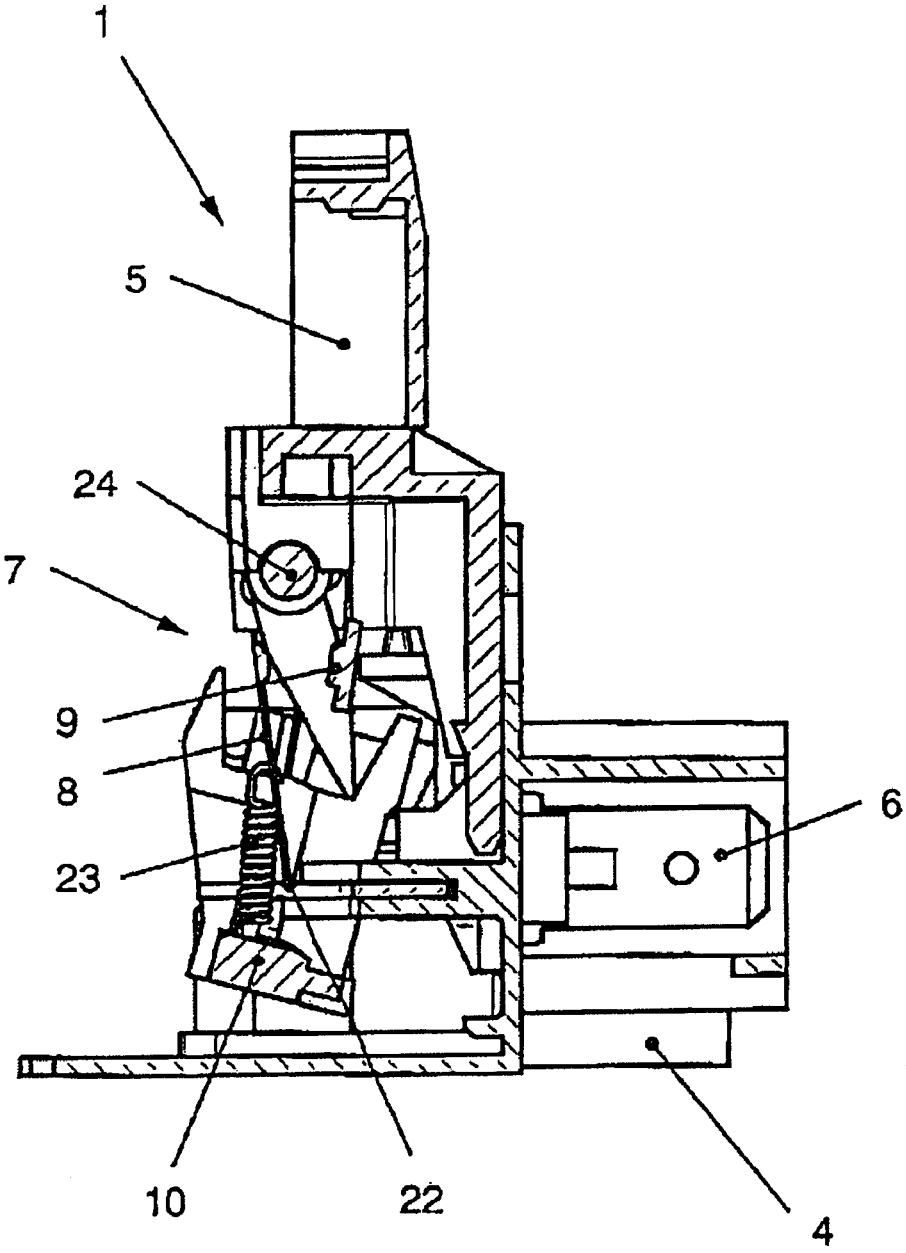
FIG. 9 shows a section along the line 9—9 in FIG. 6.
Figure 10:
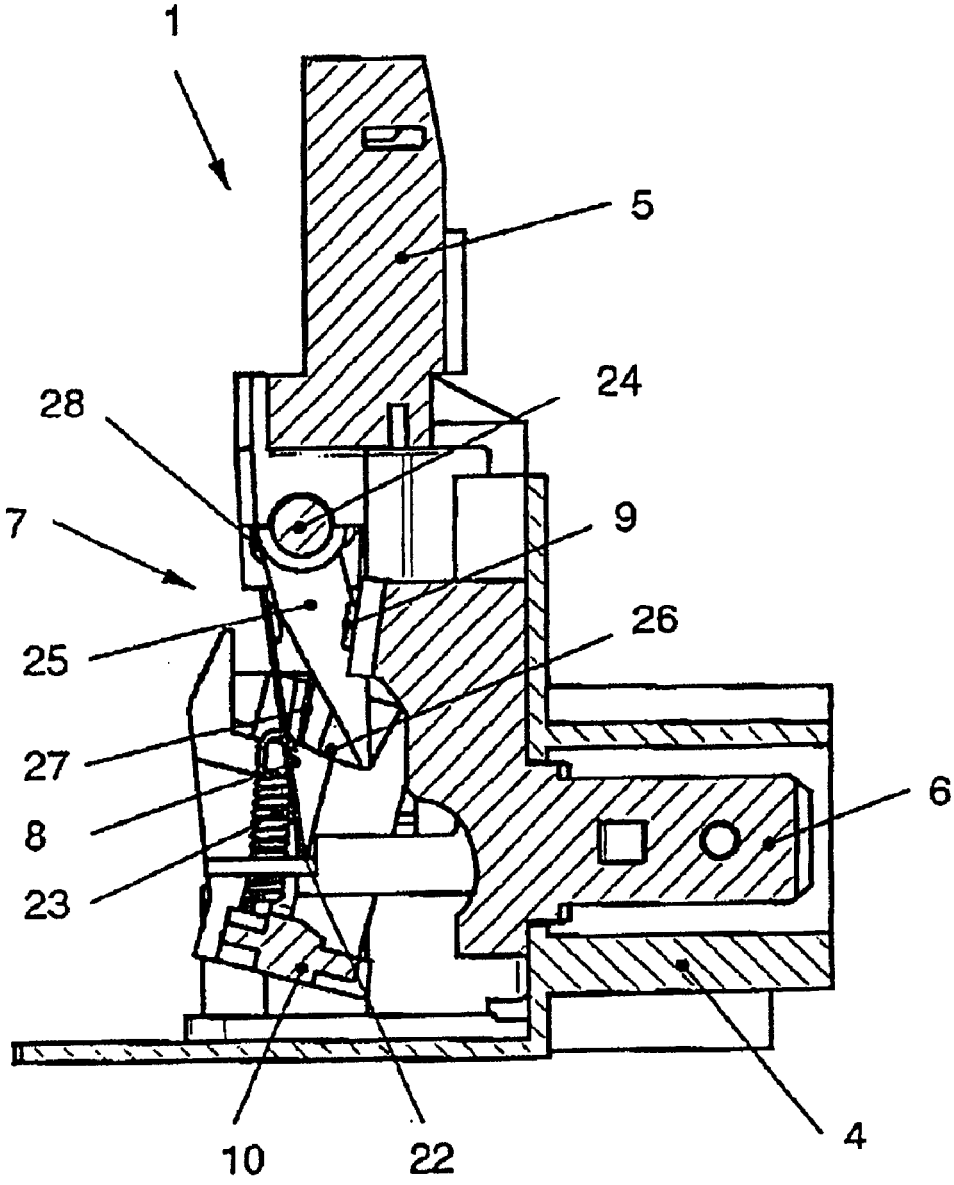
FIG. 10 shows a section along the line 10—10 in FIG. 6.

The contact system 7 is a snap-action contact system, in that the switching contact 8 is configured as a snap-action switching contact, as is evident from FIG. 9. The switching contact 8 is pivotably mounted in a knife-edge bearing 22 located at an electrical terminal 6. An elastic means, to be precise in the present case a tension spring 23, is fastened by one end to the switching contact 8 and by the other end to the lever 10. For fastening, the tension spring 23 is hung by means of end hooks in corresponding eyes both on the switching contact 8 and on the lever 10. The eye on the lever 10 for fastening the tension spring 23 is in this case located on the side opposite from the bearing 12 of the lever 10, as FIG. 7 reveals. The configuration of the switching contact 8 as a snap-action switching contact has the effect that, when there is movement of the lever 10, the switching contact 8 switches between its two end positions with snapping action.

As already mentioned, the actuation member 5 of the switch 1 is formed as a substantially linearly movable pushbutton, which is moved by corresponding manual action being exerted by the user. The lever 10 and/or the switching contact 8, and consequently the contact system 7, are arranged approximately parallel to the direction of movement of the actuation member 5, as can be seen from FIG. 9. It goes without saying that the lever 10 and/or the switching contact 8 may also be arranged approximately perpendicular to the direction of movement of the actuation member 5, which however is not shown any further.

Figure 8:
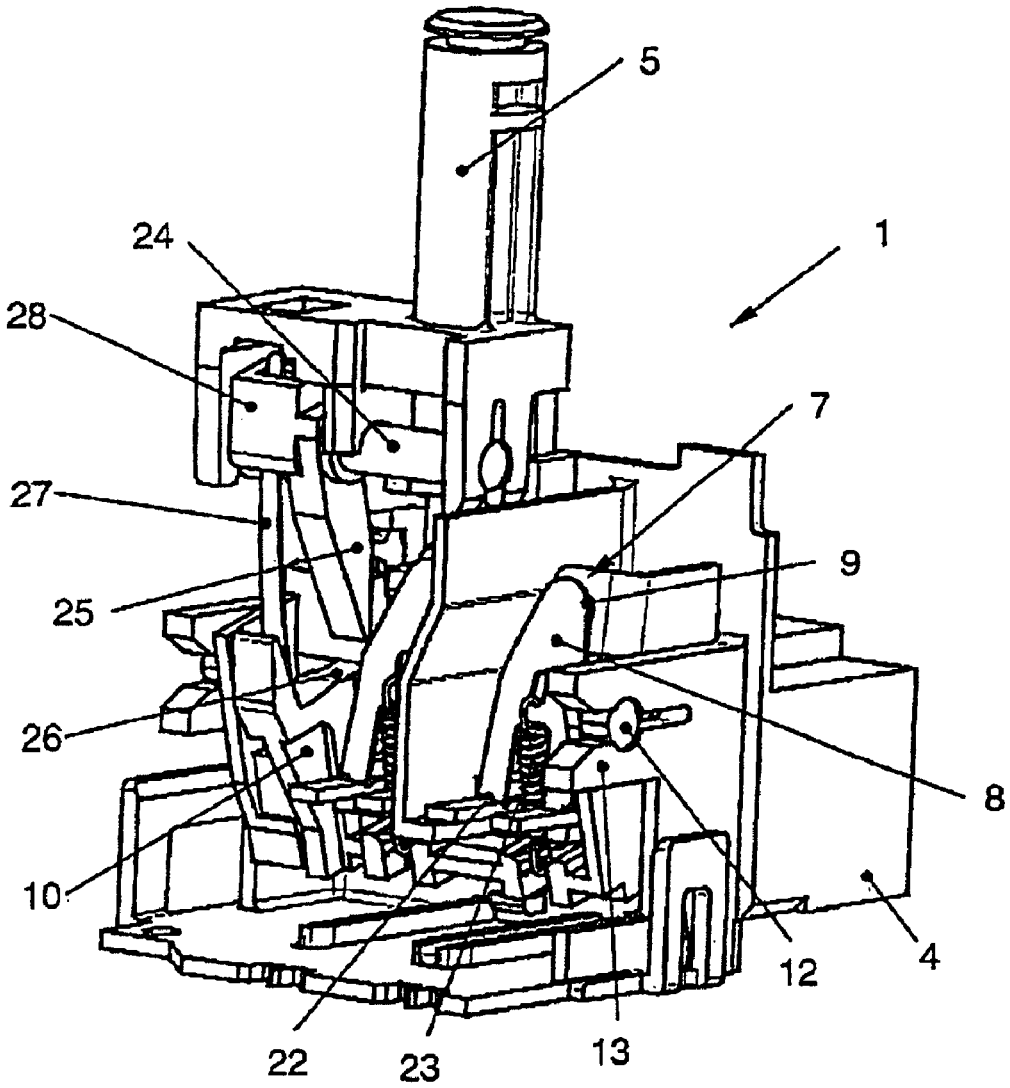
FIG. 8 shows the electric switch as in FIG. 7, but the contact system being in the switching-on state.

As can be seen in more detail from FIG. 8, the rocker 24 serves for the pivoting of the lever 10. The rocker 24 is pivotably mounted on the actuation member 5 and engages the lever 10 by means of an arm 25, in order to establish the operative connection between the actuation member 5 and the lever 10. As can be seen in particular in FIG. 10, the location where it engages on the lever 10 is configured in the manner of a slideway 26, so that, when there is movement of the actuation member 5, the pivoting of the rocker 24 for its part brings about a pivoting of the lever 10. In addition, a spring element 27, which can be seen in FIG. 7, is restrained by its one end on the lever 10, to be precise on the side opposite from the bearing 12 of the lever 10. The spring element 27 is preferably configured in the manner of a leaf spring or a wire spring, as can be seen from FIG. 5. The spring element 27 interacts by its other, projecting end with the rocker 24 in such a way that, when there is movement of the actuation member 5, the lever 10 is pivoted alternately from one end position into the other end position, respectively. On the rocker 24 there is a receptacle 28 with a slot 29 for the projecting end of the spring element 27, as can be seen from FIG. 5.

In one of these stable end positions, the contact system 7 is then respectively in the switching-on state or in the switching-off state. Although the actuation member 5 is moved between a starting position and an actuating position for the purpose of switching the contact system 7, after switching the actuation member 5 returns to the starting position of its own accord. Consequently, the actuation member 5 assumes the same position both in the switching-on state and in the switching-off state of the contact system 7, that is to say the starting position, whereby the switch 1 according to the second exemplary embodiment is configured in the manner of a "push-push" switch. In the case of the switch 1 according to the first exemplary embodiment, on the other hand, the actuation member 5 remains in the respective position, in that the actuation member 5 is interlocked in the actuating position.

The invention is not restricted to the exemplary embodiments described and represented. Rather, it also comprises all developments by a person skilled in the art within the scope of the invention defined by the patent claims. For instance, a switch of this type can not only be used for switching high power levels but in all applications where a small actuating displacement is desired, in particular in the case of electric switches formed in the manner of short-stroke buttons.

LIST OF DESIGNATIONS

1: electric switch
2: housing
3: cover
4: base
5: actuation member
6: electrical terminal
7: contact system
8: switching contact
9: stationary contact
10: lever
11: locking means
12: bearing
13: receptacle (for bearing)
14: sleeve
15: compression spring
16: control cam
17: knife-edge bearing
18: locking camway
19: pin
20: spring (for actuation member)
21: receptacle (in the actuation member)
22: knife-edge bearing
23: tension spring
24: rocker
25: arm (on the rocker)

26: slideway (on the lever)
27: spring element
28: receptacle (on the rocker)
29: slot (in the receptacle)

What is claimed:

1. An electric switch comprising:

at least one contact system, said contact system comprising at least one movable switching contact and at least one stationary contact;

a movable actuation member; and a housing, said actuation member, when moved, interacting with said switching contact to switch said contact system, said actuation member being in operative connection with a lever in such a way that, when there is movement of said actuation member, said lever carries out a pivoting movement, said pivoting movement of said lever moving said switching contact to a switch said contact system, at least a portion of said switching contact moving a distance which exceeds a distance of said movement of said actuation member, said lever being configured as a one-armed lever, said lever being pivotably mounted on a bearing, said bearing being arranged at an end of said lever in said housing.

2. The electric switch as claimed in claim 1, wherein said switch has a number of contact systems, each said contact system comprising a switching contact.

3. An electric switch as recited in claim 2, wherein said lever moves each of said switching contacts.

4. The electric switch as claimed in claim 1, wherein said switching contact is configured in a form of a rocker, and in that an end of said lever which is opposite from said bearing of the lever, bears with an elastic force against said switching contact.

5. The electric switch as claimed in claim 1, wherein said lever comprises a sleeve, compression spring for exerting an elastic force is arranged in said sleeve, said compression spring acts on a control cam, and said control cam acts on said switching contact.

6. The electric switch as claimed in claim 1, wherein said actuation member is substantially linearly movable pushbutton which acts against a force exerted by a spring, part of said actuation member protrudes out of said housing for manual access by a user, and said lever passes through a receptacle, which is arranged on a part of said actuation member located inside said housing, approximately transversely with respect to a direction of movement of said actuation member in such a way that, when there is movement of said actuation member, said lever is pivoted.

7. The electric switch as claimed in claim 1, wherein said switching contact is configured as a snap-action switching contact, said switching contact is pivotably mounted in a knife-edge bearing, which is located at an electrical terminal, and a tension spring is fastened at a first end to said switching contact and at a second end to said lever on a side opposite from said bearing of said lever, in such a way that, when there is movement of said lever, said switching contact switches with snapping action between two end positions of said lever.

8. The electric switch as claimed in claim 1, wherein said actuation member is formed as a substantially linearly movable pushbutton which acts against a spring force, a rocker is pivotably mounted on said actuation member, said rocker engages said lever by means of an arm at a slideway, to establish an operative connection, and a spring element, which is restrained at a first end on said lever on a side opposite from said bearing of said lever, and which is configured as a leaf spring or a wire spring, interacts at a second, projecting end with said rocker by engagement in a slot at a receptacle of said rocker, in such a way that, when there is movement of said actuation member, said lever is pivoted alternately from a first end position into a second end position, respectively.

9. The electric switch as claimed in claim 1, wherein at least one of said lever and said switching contact is arranged relative to a direction of movement of said actuation member in a relationship selected from the a group consisting of approximately parallel and approximately perpendicular, and said lever is configured approximately in a form of a fork, with two mutually opposite bearings.

10. The electric switch as claimed in claim 1, wherein said actuation member can be moved between a starting position and an actuating position for switching the contact system, after switching, the actuation member being interlocked in a respective position or returning to said starting position of its own accord.

11. An electric switch as recited in claim 1, wherein said electric switch is a power switch for a high load.

12. An electric switch as recited in claim 1, further comprising a movable locking means which selectively interacts with said actuation member in an interlocking manner, wherein when there is movement of said actuation member to cause said pivoting movement of said lever, at least a portion of said locking means moves a distance which exceeds said distance of movement of said actuation member and said locking means interlocks said actuation member.

13. The electric switch as claimed in claim 12, wherein said locking means comprises an approximately heart-shaped locking camway and a pin engaging in said locking camway, said locking camway can be moved by means of said lever, and said locking camway is arranged on a side of said lever which is approximately opposite from said bearing.

14. The electric switch as claimed in claim 12, wherein said locking means comprises a pin configured approximately in the manner of a bow, a first end of said bow is held in said housing and a second end of said bow engages as a pin in a locking camway, and when there is movement of said locking camway, said pin is acted on by an elastic force directed counter to deflection by said locking camway.

15. An electric switch as recited in claim 12, wherein said lever moves said at least one switching contact and said locking means.

16. An electric switch comprising:

at least one contact system, said contact system comprising at least one movable switching contact and at least one stationary contact; and a movable actuation member, said actuation member, when moved, interacting with said switching contact to switch said contact system, said actuation member being in operative connection with a lever in such a way that, when there is movement of said actuation member, said lever carries out a pivoting movement, said pivoting movement of said lever moving said switching contact to switch said contact system, at least a portion of said switching contact moving a distance which exceeds a distance of said movement of said actuation member, said lever passing through a receptacle, which is arranged on said actuation member, approximately transversely with respect to a direction of movement of said actuation member in such a way that, when there is movement of said actuation member, said lever is pivoted, said lever comprising a sleeve, a compression spring for exerting an elastic force being arranged in said sleeve, said compression spring acting on a control cam, and said control cam acting on said switching contact.

17. An electric switch comprising:

at least one contact system, said contact system comprising at least one movable switching contact and at least one stationary contact; and a movable actuation member, a lever;

a rocker, said rocker being pivotably mounted on said actuation member, said rocker engaging said lever by means of an arm at a slideway, to establish an operative connection;

a spring element, said spring element being restrained at a first end on said lever on a side opposite from said bearing of said lever, said spring element being configured as a leaf spring or a wire spring and interacting at a second, projecting end with said rocker by engagement in a slot at a receptacle of said rocker, in such a way that, when there is movement of said actuation member, said lever is pivoted alternately from a first end position into a second end position, respectively, said actuation member, when moved, interacting with said switching contact to switch said contact system, said actuation member being in operative connection with said lever in such a way that, when there is movement of said actuation member, said lever carries out a pivoting movement, said pivoting movement of said lever moving said switching contact to switch said contact system, at least portion of said switching contact moving a distance which exceeds a distance of said movement of said actuation member.

* * * * *